US005390936A

United States Patent [19]

Westenburg

[11] Patent Number: 5,390,936

[45] Date of Patent: Feb. 21, 1995

[54] BLADE FOR ARROW BROADHEAD

[76] Inventor: Michael E. Westenburg, 1409 4th St., Bay City, Mich. 48708

[21] Appl. No.: 140,435

[22] Filed: Oct. 25, 1993

[51] Int. Cl.[6] ..... F42B 6/08

[52] U.S. Cl. ..... 273/422

[58] Field of Search ..... 273/416, 419–423; 606/82

[56] References Cited

U.S. PATENT DOCUMENTS

| | | | |
|---|---|---|---|
| 2,350,581 | 6/1944 | Boose | 273/421 |
| 2,691,527 | 10/1954 | Ramsey | 273/421 |
| 2,820,637 | 1/1958 | La Fond | 273/421 |

FOREIGN PATENT DOCUMENTS

| | | | |
|---|---|---|---|
| 2656788 | 7/1991 | France | 606/82 |

OTHER PUBLICATIONS

Archery, Feb. 1977 p. 6 "Ripper" & Magnum.

Bow & Arrow Hunting, Dec. 1990 pp. 38, 48 "Promaster" & Terminator Double Cut.

1989 XI Compound Bows and Accessories, Jun. 1989, A3979 XI The Edge Broadheads.

*Primary Examiner*—Paul E. Shapiro

*Attorney, Agent, or Firm*—Merlin B. Davey

[57] ABSTRACT

A blade for an arrow broadhead wherein each tooth of a serrated cutting edge is pointed toward the point of the broadhead and each tooth is sharpened.

2 Claims, 1 Drawing Sheet

BLADE FOR ARROW BROADHEAD

BACKGROUND OF THE INVENTION

A broadhead arrow customarily comprises two or three replaceable blades set apart at an angle of 180° or 120°. Such blades are generally metallic and are sharpened to provide a more effective cutting edge. In recent developments the cutting edge of said blades is serrated, providing, in effect, a number of cutting teeth. However, even with such improvements, it is not uncommon for an arrow, when striking a skeletal bone, to glance off the target, leaving a wounded deer, for example, which is able to elude the hunter only to die a painful, lingering death. It is, therefore, a desideratum of the art to provide a still more effective blade for an arrow broadhead and, in particular, a blade capable of piercing skeletal bones and more effectively killing a hunted animal.

SUMMARY OF THE INVENTION

This invention provides a blade for an arrow broadhead, said blade having a serrated cutting edge wherein each tooth of the serrated cutting edge is pointed toward the point of the broadhead and each tooth is sharpened.

DETAILED DESCRIPTION OF THE INVENTION

More particularly, this invention provides a blade for an arrow broadhead, said blade having a serrated cutting edge, wherein each tooth of the serrated cutting edge is pointed toward the point of the broadhead and each tooth is sharpened from its point to its base or bottom on at least one edge or side, preferably on both edges or sides.

More specifically, this invention provides a generally triangular blade for an arrow broadhead comprising a mounting edge and a serrated cutting edge, each of said edges having a front end and a rear end, said cutting edge extending rearwardly from the front end of said mounting edge at an angle thereto, said blade further comprising a rear edge extending between and connecting the rear end of said cutting edge with the rear end of said mounting edge, each tooth of said serrated cutting edge comprising a curved front edge, a forwardly facing point and a side cutting edge, said curved front edge having a first portion extending rearwardly and in a direction away from said mounting edge and a second portion extending forwardly and in a direction away from said mounting edge, said second portion intersecting said side cutting edge of said tooth to form a forwardly facing point, said side cutting edge beginning at said forwardly facing point and extending rearwardly from said point to the first portion of the curved front edge of the next tooth, the forwardly facing and side cutting edges of each tooth being sharpened.

DESCRIPTION OF THE DRAWINGS

The invention may be further understood by reference to the accompanying drawings wherein:

Referring to FIG. 1, blade (10) is seen to comprise numerous teeth or serrations (12) pointing toward the point (14) of said blade (10). Referring to FIGS. 1 and 3, blade 10 is seen to have a mounting edge (11), a cutting edge (13) and a rear edge (15). Each tooth (12) comprises a curved front edge (18), a point (16) and a side cutting edge (20). The curved front edge (18) has a first portion (19) extending rearwardly and in a direction away from the mounting edge (11), and a second portion (21) extending forwardly from the first portion (19) and in a direction away from the mounting edge (11), said second portion (21) intersecting the side cutting edge (20) of the tooth to form the forwardly facing point (16) thereof, the side cutting edge (20) beginning at the forwardly facing point (16) and extending rearwardly from the point (16) to the first portion of the front edge (18) of the next tooth.

Figure 1:
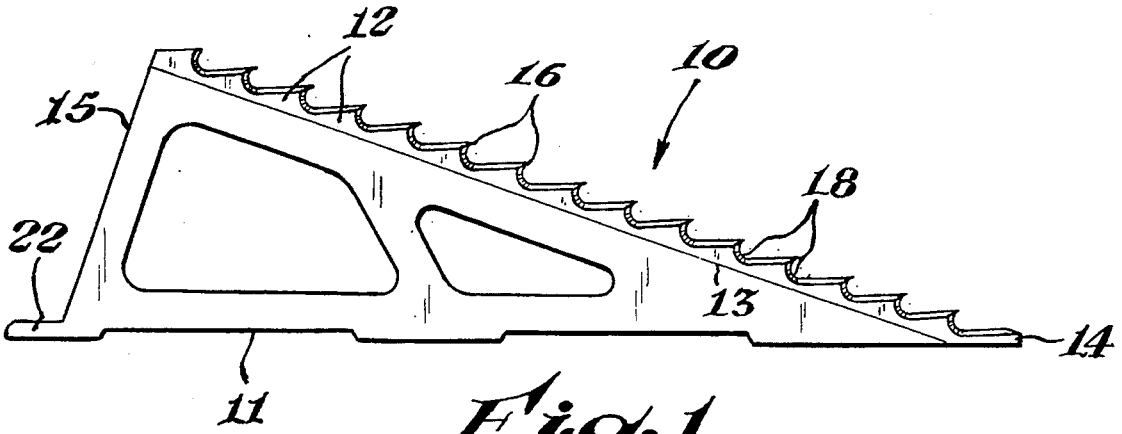
FIG. 1 is a side elevation of a blade in accordance with one embodiment of the present invention.
Figure 2:
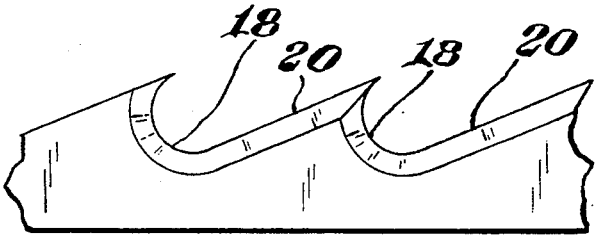
FIG. 2 is an enlarged fragmentary elevation showing several sharpened teeth in accordance with one embodiment of the present invention.
Figure 3:
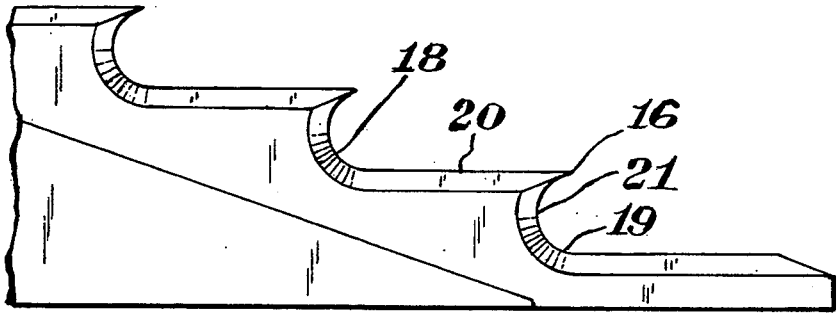
FIG. 3 is an enlarged fragmentary elevation showing further detail of the sharpened teeth illustrated in FIG. 1.

Teeth (12) are sharpened from their points (16) to their base or bottom (18) on at least one side, as shown more clearly in FIG. 2, where (20) indicates the sharpened surface or cutting edge.

Base (18) may have a radius of curvature of 0–75 thousandths of an inch. Blades in accordance with this invention advantageously have from about 6 to about 12 serrations per inch with the depth of the cut from the point of the serrations to the base varying from about 60 thousandths for the coarser cuts to about 30 thousandths for the finer cuts. The blades may be handcrafted or machined from blank blades that are available on the market. As is known in the art, blade (10) is adapted to fit into a groove on an arrow shaft (not shown) such that point (14) is engaged at the forward end of the arrow and projection or handle (22) can be engaged by a circular fastener (not shown) movably positioned on the arrow shaft (not shown).

It has been found that blades constructed as herein taught and illustrated are very effective at penetrating skeletal bones of animals such as deer, and are therefore less apt to glance off leaving a wounded animal to elude the hunter only to die a lingering death from the wound.

Various modifications may be made in the present invention without departing from the spirit or scope thereof as will be apparent to those skilled in the art.

I claim:

1. A generally triangular blade for an arrow broadhead comprising, a mounting edge, a cutting edge extending rearwardly from the front end of the mounting edge at an angle thereto and a rear edge extending between the rear end of the cutting edge and the rear end of the mounting edge, the cutting edge having from about 6 to about 12 teeth per inch, each tooth comprising a curved front edge, a forwardly facing point and a side cutting edge, the curved front edge having a first portion extending rearwardly and in a direction away from the mounting edge, and a second portion extending forwardly from the first portion and in a direction away from the mounting edge, the second portion intersecting the side cutting edge of the tooth to form the forwardly facing point thereof, the side cutting edge beginning at the forwardly facing point and extending rearwardly from the point, generally parallel to the mounting edge, to the first portion of the front edge of the next tooth, the forwardly facing and side cutting edges of each tooth being sharpened and the perpendicular distance between succeeding side cutting edges being in the range from about 30 thousandths to about 60 thousandths of an inch.

2. A generally triangular blade for an arrow broadhead comprising a mounting edge and a serrated cutting edge, each of said edges having a front end and a rear end, said cutting edge extending rearwardly from the front end of said mounting edge at an angle thereto, said blade further comprising a rear edge extending between and connecting the rear end of said cutting edge with the rear end of said mounting edge, each tooth of said serrated cutting edge comprising a curved front edge, a forwardly facing point and a side cutting edge, said curved front edge having a first portion extending rearwardly and in a direction away from said mounting edge and a second portion extending forwardly and in a direction away from said mounting edge, said second portion intersecting said side cutting edge of said tooth to form a forwardly facing point, said side cutting edge beginning at said forwardly facing point and extending rearwardly from said point to the first portion of the side cutting edge of the next tooth, the forwardly facing and curved front edges of each tooth being sharpened.

* * * * *